United States Patent [19]

Endriz

[11] Patent Number: 4,934,273

[45] Date of Patent: Jun. 19, 1990

[54] LASER FLARE

[75] Inventor: John G. Endriz, Belmont, Calif.

[73] Assignee: Spectra Diode Laboratories, Inc., San Jose, Calif.

[21] Appl. No.: 368,603

[22] Filed: Jun. 20, 1989

[51] Int. Cl.[5] ..... F42B 4/26

[52] U.S. Cl. ..... 102/336; 102/337

[58] Field of Search ..... 102/336, 337; 244/3.11; 42/103

[56] References Cited

U.S. PATENT DOCUMENTS

| | | | |
|---|---|---|---|
| 1,781,621 | 11/1930 | Wiley | 102/337 |
| 1,937,219 | 11/1933 | Driggs | 102/24 |
| 1,937,220 | 11/1933 | Driggs | 102/24 |
| 4,158,323 | 6/1979 | Stirrat et al. | 89/1.5 |
| 4,448,106 | 5/1984 | Knapp | 102/334 X |
| 4,719,856 | 1/1988 | Joslin | 11/335 X |
| 4,761,907 | 8/1988 | De Bernardini | 42/103 X |
| 4,768,736 | 9/1988 | Morten | 244/3.11 |
| 4,791,870 | 12/1988 | Simpson | 102/342 |

*Primary Examiner*—Peter A. Nelson

*Attorney, Agent, or Firm*—Thomas Schneck

[57] ABSTRACT

A compact laser flare illuminator includes a semiconductor diode laser array radiation source, an energy source for the radiation source that can be switched on and a housing which holds the array and energy source, while allowing egress of a beam. This illuminator may be used to facilitate night vision by persons wearing night vision goggles or using other types of wavelength-selective night vision devices. The housing may serve as a heat sink and may be equipped with a propulsion device and with fins for flight stabilization, as well as with a parachute for slowing descent from an altitude above an area to be illuminated. A wavelength filter that passes radiation only in a predetermined wavelength range and a lens or optical element to focus the laser radiation toward the area to be illuminated are optional features.

30 Claims, 2 Drawing Sheets

LASER FLARE

TECHNICAL FIELD

This invention relates to area illumination and in particular to a laser source for terrain illumination.

BACKGROUND ART

The recent acquisition of large numbers of night vision goggles by the U.S. Armed Forces has created an opportunity for use of covert, convenient and combat-safe area illuminators in the form of wavelength-selective flares, where the selected wavelength range is chosen to coincide with the range of wavelength for night vision that is provided by the night vision goggles. The flare unit should be small, preferably no larger than a cigarette package in size, should carry its own energy supply, should provide some means of controlling the direction of the illumination provided by the flare, and should provide some means for selecting the wavelength range that is emitted by the flare unit for illumination purposes.

Conventional flares have been known for more than half a century. Wiley, in U.S. Pat. No. 1,781,621, discloses a flare device that is initially attached to an aircraft; the flare can be launched by a spring unit from the aircraft at an appropriate time as the flare material is activated, to provide illumination for aircraft maneuvers or landing and takeoff.

A conventional flare supporting and firing device is disclosed in U.S. Pat. No. 1,937,219, issued to Driggs. This device is also designed to be attached to an aircraft and uses an activatable powder charge to expel the flare from the aircraft and illuminate the chosen area. Another patent by Driggs, U.S. Pat. No. 1,937,220, discloses an invention that is similar to the other Driggs invention but uses a metal closure cap to retain the flare when the flare is not to be activated.

Stirrat et al, in U.S. Pat. No. 4,158,323, discloses a flare dispensing system that mounts a plurality of flares on a module that is hung or tethered from an aircraft or helicopter. The flares are individually released and activated, and the flares fall toward the ground and provide illumination of a region of ground beneath the activated flare. The released flare may be carried in a parachute to reduce the vertical velocity and thereby increase the time interval during which illumination is provided by the activated flare.

None of these inventions discloses a flare device of small size that emits radiation only in a predetermined wavelength range, whose radiation can be focused or directed primarily in a narrow cone of directions to selectively illuminate a particular area, and that can be reused.

One object of this invention is to provide a self-contained flare unit that is small, carries its own energy supply, can be activated and deactivated at will, and can be reused.

Another object of this invention is to provide a flare unit where the radiation can be controllably focused for illumination of a particular area.

Another object of this invention is to provide a flare unit for which only a selected range of radiation wavelength is emitted for illumination purposes.

These objects, and advantages thereof, will become clear by reference to the detailed description and the accompanying drawings.

DISCLOSURE OF THE INVENTION

The above objects have been met with a laser flare that uses a small, high efficiency laser such as a semiconductor diode laser array that is driven by a small energy unit such as a battery that is part of the laser flare unit. The laser is adjacent to or surrounded by a passive heat sink that absorbs most or all of that portion of the power or energy supplied the laser that is dissipated as heat. The laser unit optionally includes a lens that receives all or a portion of the laser radiation emitted by the laser and focuses this received portion of the radiation in a cone of a predetermined cone angle so that the illumination intensity within this cone is enhanced. The laser flare unit may be also provided with a wavelength-selective cutoff filter, positioned adjacent to the optical element, that permits only radiation within a predetermined wavelength range to be emitted by the laser flare unit for illumination purposes. For an airborne deployment mode, the laser flare unit is provided with an attached parachute to minimize the rate of descent of the laser flare unit.

BEST MODE FOR CARRYING OUT THE INVENTION

Figure 1:
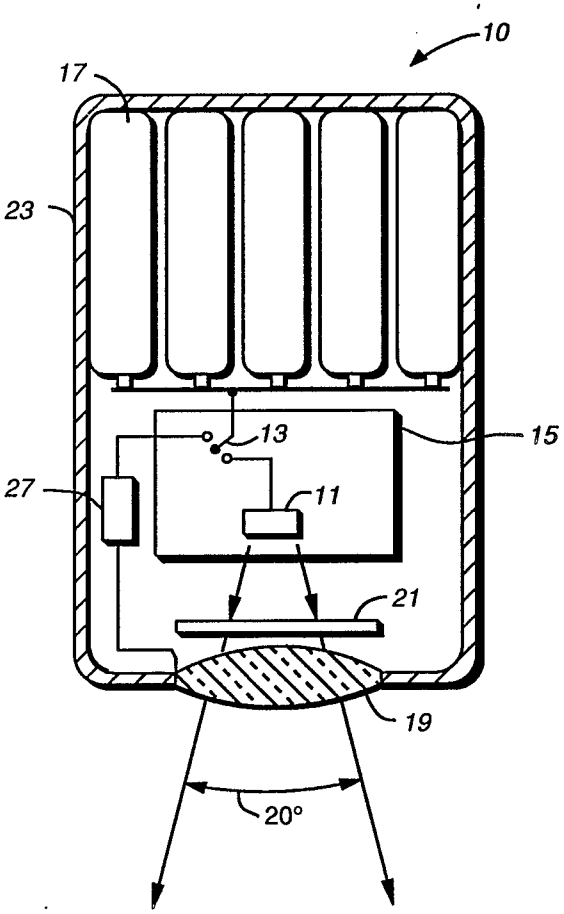
FIG. 1 is a cut away view of a preferred embodiment of the invention.

With reference to FIG. 1, a preferred embodiment of the laser flare unit 10 includes a laser radiation source, such as a semiconductor diode laser array 11, that is activated or deactivated by a switch 13. The switch is activated either remotely, by a radio or telemetry link, or locally by an altimeter 27. A passive heat sink 15 is positioned adjacent to or substantially surrounding the laser 11. A laser energy source 17, such as a battery or plurality of batteries, is connected to and drives the laser 11. An optional lens 19 receives part or all of the laser radiation emitted by laser 11 and focuses this radiation in a predetermined direction within a cone angle $_0$. Lens 19 provides a divergent beam. If either the lens or the source is moveable, the amount of divergence may be adjusted. For example, a small motor could be used to move lens 19 to widen or narrow the cone angle.

A wavelength-selective filter 21 is positioned adjacent to or coincident with the lens 19 to remove all laser radiation except radiation within one or more predetermined wavelength ranges, thus producing wavelength-cutoff radiation. The filter 21 can be positioned between the lens 19 and the laser 11, with the filter support, not shown, in thermal communication with the heat sink. This allows any heat deposited or generated in the filter 21 to be removed by the heat sink 15 that also serves the laser 11. Alternatively, the filter 21 may be positioned between the lens 19 and the area to be illuminated. With this first alternative configuration, any heat deposited or generated in the filter 21 would be removed by the ambient medium in which the laser flare unit 10 is operated. As a second alternative, the filter 21 may be included as part of the lens 19, in which case the lens 19 might be cooled primarily by the ambient medium.

The laser flare unit 10 includes a compact enclosure or housing 23 that surrounds laser 11, passive heat sink 15, laser energy source 17 and part or all of the lens 19. If the laser flare unit 10 is to be launched by a high acceleration launcher means, the enclosure 23 should be made of metal or other high strength material that can withstand the forces produced by the high acceleration launch.

Laser 11 may be, for example, a CW, i.e. continuous, semiconductor diode laser array of power in the range 0.1-several watts, preferably greater than 0.8 watts, that emits radiation in the wavelength range $\lambda=0.8-0.9$ $\mu$m or in another part of the infrared wavelength spectrum. Such a laser, operating at 40% efficiency, will dissipate energy at a rate of 0.15–60 watts, depending on the power of the laser. This substantial energy dissipation indicates use of passive heat sink 15, mentioned above. The heat sink is mounted adjacent to or substantially surrounding laser 11 to remove most or all of the heat generated in the laser material by this dissipation. Suitable heat sink materials are sapphire, diamond, copper, or aluminum. When operation of the laser is so extensive that removal of integrated dissipated power becomes a problem, then a heat sink containing a low boiling point evaporating fluid can provide enhanced cooling. Power dissipation of several watts from the laser 11 over several minutes of operation can be obtained from heat spread and dissipation designs of a few cubic centimeters volume. With moderate air velocities associated with use in a parachute configuration, dissipation in excess of 10 watts is possible with under 20° C. rise in laser temperature. A diode laser, initially at an ambient temperature of 20° C., can undergo a temperature rise to about 50° C. before the performance of the laser degrades substantially.

Another possible class of heat sink materials is a class of relatively low melting point solids such as sodium, bismuth and cesium. The total thermal energy dissipated by heating a block of such material of volume V from a temperature $T_1$ to a temperature $T_2$ that is just above the melting point of this material is approximately $[C_p(T_2-T_1)+\Delta H_f]$ V, where $C_p$ is the average specific capacity of the solid and $\Delta H_f$ is the specific heat of fusion of this melting solid.

A third class of heat sink materials is a group of liquids with relatively low boiling point temperatures in the range of 30°–60° C. such as various organic fluids, such as ether and ethyl alcohol. Here, the specific heat capacity and heat of vaporization of the liquid are relied upon for absorption of heat from the laser unit 10.

If the laser flare unit 10 is deployed in an airplane or helicopter, or if the unit 10 descends toward the ground with a parachute, the heat sink 15 may communicate with external fins discussed below that are exposed to the ambient air and are connected to the laser 11 by a material that has very high thermal conductivity; heat produced by the laser 11 would be quickly conducted to the heat fins by thermally conductive pathways. Heat in the fins would be radiated and convected away through passing air or other gases.

The semiconductor laser material itself may be any of the materials set forth below on Table 1.

TABLE 1

| Material | Emission Wavelengths ($\lambda$ in $\mu$m) |
|---|---|
| InGaP | 0.5–0.7 |
| $GaAs_xP_{1-x}$ | 0.65–0.84 ($0 \leqq x \leqq 1$) |
| $Ga_{1-x}Al_xAs$ | 0.69–0.85 |

TABLE 1-continued

| Material | Emission Wavelengths ($\lambda$ in $\mu$m) |
|---|---|
| GaAs | 0.837–0.843 |
| $Ga_xIn_{1-x}As$ | 0.84–3.5 |
| InP | 0.907 |
| $InAs_xP_{1-x}$ | 0.91–3.5 |
| GaSb | 1.6 |
| InAs | 3.1 |
| InSb | 5.26 |
| PbTe | 6.5 |
| PbSe | 8.5 |
| $Pb_{1-x}Sn_xTe$ | 9.5–28 |

Other semiconductor materials may also provide laser radiation in the visible or infrared wavelength range.

Another group of semiconductor materials, the direct bandgap quaternaries, offer even broader ranges of emission wavelengths and include the following:

TABLE 2

| Material | Emission Wavelenths ($\lambda$ in $\mu$m) |
|---|---|
| (AlGaIn)P | 0.55–0.8 |
| AlInAsP | 0.55–3.5 |
| AlInPSb | 0.55–7 |
| InGaPSb | 0.58–7 |
| InGaAsP | 0.59–3.5 |
| (AlGaIn)As | 0.60–3.5 |
| AlInAsSb | 0.61–4 |
| AlGaAsP | 0.62–0.84 |
| Ga(AsPSb) | 0.65–1.7 |
| AlGaAsSb | 0.65–1.8 |
| In(AsPSb) | 0.8–7 |
| (AlGaIn)Sb | 0.8–7 |
| InGaAsSb | 0.81–13 |
| AlGaPSb | 1.0–1.7 |

The energy source or batteries 17 must be capable of delivering energy at a rate in the range of 0.15–150 Watts, depending on laser output power required, although the time interval for activation of the laser flare unit may be a relatively short interval such as 60–180 sec. Use of high energy storage, low impedance batteries allows the laser flare unit 10, operating at one watt nominal power, to be turned on at full power for a few minutes before the batteries are depleted. The batteries are preferably rechargeable so that the laser flare unit 10 can be recycled and reused many times. Battery life could be extended by pulsing the laser rather than operating in a continuous mode. A means of deployment of the laser flare unit 10 is to drop the laser flare unit with a parachute attached from a great height, e.g., from an airplane over the area to be illuminated.

The laser flare unit 10 shown in FIG. 1 is approximately the size of a cigarette package, e.g., 2 cm.×10 cm.×15 cm. in size, and the focal length of lens 19 might be chosen to be in the range 2–20 cm. depending on the predetermined cone angle $\theta_0$ for the radiation to be emitted by the laser flare unit 10. The lens is preferably a cylindrical lens if the laser is a line source. A wavelength-selective dye might be incorporated as a coating on the lens 19 or might be included in the material of the lens itself. If it is expected that the cutoff filter 21 will itself generate a great deal of thermal energy in removing the radiation with unwanted wavelengths from the emitted beam, a cutoff filter 21 that is either a coating on the lens 19 or is spaced apart from the lens 19 may be preferable.

When the laser flare unit 10 is used together with newer night vision goggles and the selected wavelength ranges, not including visible wavelengths, of the laser and the cutoff filter 21 are within the covert night vision range of the goggles, the laser flare unit 10 provides high intensity light that is visible to goggle wearers but is invisible to other persons.

A semiconductor diode laser emits laser radiation with a relatively small cone angle $\theta_r$; typically, less than 10° If the area to be illuminated by the laser flare unit 10 permits use of a cone angle $\theta_0$ of the order of $\theta_r$, the lens 19 in FIG. 1 may be deleted from the laser flare unit. Ample power is obtained from a multi-emitter diode laser array. Continuous wave output power in excess of five watts is available with a monolithic array of 100 emitters as disclosed by G. Harnagel et al. in Electronic Letters, 605 (1986). However, because of the sensitivity of night vision goggles, output power of only two or three watts is ample for illuminating a wide area. High output powers have been achieved in laser arrays using aluminum gallium arsenide (AlGaAs) ternary crystal alloys and metal-organic chemical vapor deposition fabrication processes.

Figure 2:
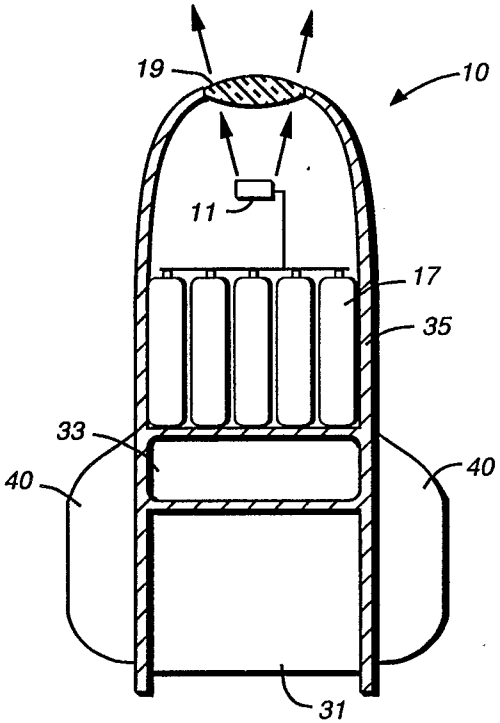
FIG. 2 is a cross-sectional view of a flare unit deployment module for use with the laser flare unit.

FIG. 2 shows a housing 30 for the laser flare unit 10. The unit is stacked upon a launch charge module 31 with a buffer zone therebetween in a housing 35. A parachute module 33 may occupy the buffer zone with an external opening, such as a hatch. When the launch charge module 31 is activated, the housing 35 that contains the laser flare unit 10 and the parachute module 33 are accelerated vertically upward, in a manner similar to launch of a rocket. After the housing 35 has reached a suitable height or altitude above the ground and has begun to fall under the action of gravity, the parachute module 33 is activated to re-orient and minimize the rate of fall of the laser flare unit 10 to which the parachute is attached. At this point, or at any lower altitude that is determined by an altimeter that may be included with the laser flare unit 10, the laser flare unit is activated and provides illumination of a selected area on the ground beneath the descending laser flare unit. The protective housing 30 may be electrically connected with the activation switch 13 so that contact with the ground is sensed through an external probe and the laser 11 is automatically deactivated through the switch 13. The housing 30 may form a portion of the heat sink for the laser 11; and in this case, the housing would be a good thermal conductor in heat transfer communication with the laser. The housing may have fins 40 for flight stabilization or for heat dissipation or both.

Figure 3:
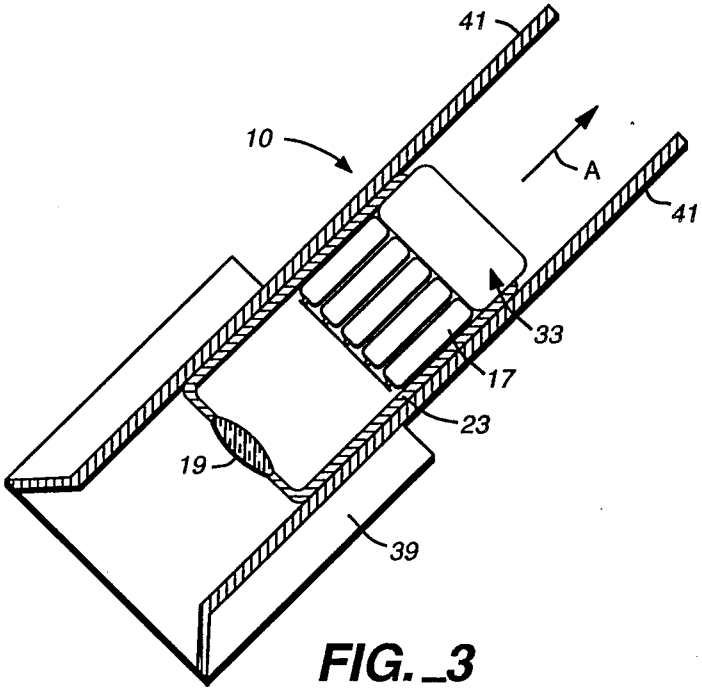
FIG. 3 is a cross-sectional view of a launcher for the flare unit module of FIG. 3.

FIG. 3 shows a launcher that allows ground or airborne deployment of the laser flare unit 10. The laser flare unit 10, with optional parachute 33 positioned above the flare unit, is positioned in an acceleration module 39 of a rail gun so that, as the rail gun is activated, the laser flare unit moves along two rails 41 and is accelerated in the direction shown by arrows A. If the optional parachute 33 is included, the parachute will open at about the time the housing 25 reaches a maximum height or a target height. Alternatively, the launch means could be a compressed air gun. Use of a rail gun or compressed air gun for launch would ensure that no visible or audible trail would identify or indicate the launch point of the laser flare unit 10.

Figure 4:
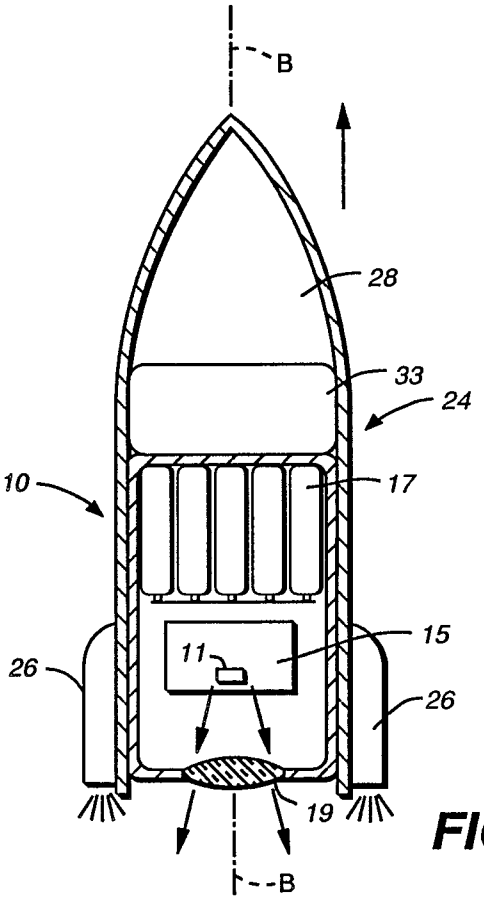
FIG. 4 is a cut away view of a rocket that may be used to launch the laser flare unit above ground level.

FIG. 4 illustrates an embodiment of the laser flare unit 10 in which the launcher is a flare housing 24 that is driven upward by means of a plurality of rockets 26 that are positioned radially about a longitudinal rocket axis BB and ar oriented to direct their force generally downward. In this embodiment, the laser 11 is activated as soon as the housing reaches a predetermined altitude. The zone 28 inside the housing 24 and above the laser flare unit 10 may be provided with a parachute 33 that is attached to either the housing 24 or to the laser flare unit 10.

In a combat situation in which the combatants on both sides have night vision goggles, the laser flare unit 10 could be used in a pulsed radiation mode that provides relatively inexpensive countermeasures for nighttime operations. The laser 11 would be pulsed at an appropriate rate to resonate with the opposition's night goggle control circuitry so that the circuit oscillates or otherwise shuts down the enemy's night vision goggles. The night vision goggles of the combatants who employ the laser flare unit 10 could be fitted with a notched frequency filter that rejects the pulsed radiation emitted by the laser 11 so that the opposing combatants may be temporarily blinded by the pulsed radiation while the combatants who use the laser flare unit 10 are unaffected by the pulsed radiation.

The laser flare unit 10 may be flown and activated aboard an airplane or helicopter, where either the flight crew or the supporting combatants on the ground use night vision goggles that are sensitive to light of the appropriate wavelength. The laser flare unit 10 may also be used with a CCD camera and microwave transmitter, to record and transmit to another location nighttime pictures of the scene below; in this instance, a remotely controlled drone might carry the laser flare unit 10, CCD camera and microwave transmitter.

As the parachute attached to the laser flare unit descends toward the ground, the altimeter will sense a decreasing altitude; and the altimeter signal might be used to change the lens configuration and output angle $_0$ as a function of altitude to illuminate approximately the same area below as the parachute descends. As an alternative, the laser flare unit 10 might be mounted on a fixed, tall pole and oriented to illuminate a fixed area on the ground. In this manner, a sequence of such laser flare unit/pole combinations might be used to provide perimeter illumination around a base camp or other areas to be protected at night.

The laser flare unit of the present invention offers the following advantages over conventional flares: (1) the unit may be activated and deactivated at will and is reusable; (2) the unit has a self-contained energy source; (3) the unit does not present a fire hazard as does a conventional flare; (4) illumination from the laser flare unit may be focused into a predetermined area by adjustment of the lens or optical element array that is part of the flare unit; (5) radiation emitted for illumination purposes by the unit may be limited to a pre-selected wavelength range.

I claim:

1. Laser flare apparatus comprising:

a semiconductor laser;

an energy source connected to the laser and having means for switching between a first state that that delivers energy to and activates the laser and a second state that does not activate the laser;

a package that contains the laser and the energy source; and means for positioning the package at a height above an area to be illuminated.

2. Apparatus according to claim 1 wherein said package is in thermal communication with said laser, said package having means for dissipating heat from said laser.

3. Apparatus according to claim 1, further comprising a radiation collimator.

4. Apparatus according to claim 3, wherein said radiation collimator comprises lens means for forming a beam diverging with a cone angle that exceeds 1°.

5. Apparatus according to claim 1, wherein said means for supporting said package comprises an activatable parachute attached to said package.

6. Apparatus according to claim 1, wherein said means for supporting said package comprises launch means for propelling said package.

7. Laser flare apparatus comprising:

semiconductor laser means for emitting radiation when the laser means is activated;

a heat sink positioned adjacent to the laser means to receive a portion or all of the energy that is dissipated as heat by the laser means;

an energy source for and connected to the laser means and being switchable between a first state that delivers energy to and activates the laser means and a second state that does not activate the laser means; and a package thermally communicating with the heat sink, the package containing the laser means, the heat sink, and the energy source.

8. The apparatus of claim 7 further comprising filter means, positioned between the laser means and an area that is to be illuminated by the laser flare apparatus, for accepting laser radiation emitted by the laser means and for removing radiation of wavelengths that lie outside a predetermined range of wavelengths.

9. The apparatus of claim 7 wherein said package defines an aperture at one position so that at least a portion of the laser radiation emitted by the laser means passes through the aperture and is directed toward an area to be illuminated.

10. Apparatus according to claim 7, further comprising an optical means, positioned between said laser means and said area to be illuminated, for receiving laser radiation emitted by said laser means and for collimating radiation.

11. Apparatus according to claim 10, wherein said optical means comprises a cylindrical lens having a finite focal length of f with lateral dimension 2D, said lens being positioned a distance d from said laser means where d is less than f and the parameters are constrained by the relations $$\tan\ \theta_o \approx \frac{(1 - d/f)}{2d/D}$$

and $\tan\ \theta_r \approx D/2d$ where $\theta_0$ and $\theta_r$ define the radiation cone between angles $\theta_0$ and $\theta_r$ produced by said laser means.

12. Apparatus according to claim 9, wherein said heat sink includes a heat-absorbing solid material.

13. Apparatus according to claim 9, wherein said heat sink includes a heat-absorbing organic liquid with a relatively low boiling point temperature and is drawn from the class consisting of ether and ethyl alcohol.

14. Apparatus according to claim 8, wherein said predetermined range of wavelengths for said filter means is contained in the range of $0.8\ \mu m \leqq \lambda \leqq 0.9\ \mu m$.

15. Apparatus according to claim 9, further comprising a parachute attached to said package and positioned so that laser radiation that exits said package aperture is directed generally toward said area to be illuminated.

16. Apparatus according to claim 7, further comprising altimeter means connected to said energy source for sensing the altitude of said package and for switching said laser means to said first state if the altitude of said package exceeds a predetermined altitude.

17. Apparatus according to claim 16, wherein said altimeter means switches said laser means to said second state if the altitude of said package is below a predetermined altitude.

18. Apparatus according to claim 15, further comprising:

altimeter means for sensing the altitude h of said laser flare apparatus; and an optical element module means, positioned between said laser means and said area to be illuminated, for receiving at least a portion of said radiation emitted by said laser means and focusing this portion of said radiation received in a cone of directions with a predetermined cone angle $\theta_0$, where the optical element module means is connected to the altimeter means and the altimeter means causes the cone angle $\theta_0$ to change as the altitude h changes.

19. Laser flare apparatus comprising:

a tubular body having a forward portion and a rearward portion and being capable of flight through air;

a semiconductor diode laser array having an output power of at least 0.8 Watts and emitting laser radiation in the wavelength range of $0.7\ \mu m \leqq \lambda \leqq 28\ \mu m$, the array being mounted in the forward portion of the tubular body and having an output beam, the laser array having a switch means for activating or deactivating the laser array;

a battery pack connected to the switch means and mounted rearward from the laser array; and means for activating the switch while the tubular body is in flight.

20. Apparatus according to claim 19, further comprising propulsion means positioned in said rearward portion of said tubular body for moving said tubular body to a desired altitude.

21. Apparatus according to claim 20, further comprising parachute means attached to said tubular body for retarding descent of said body.

22. Apparatus according to claim 20, wherein said propulsion means comprises a rocket motor.

23. Apparatus according to claim 19, wherein said tubular body has radially disposed fins for flight stabilization, the radial fins being in thermal communication with said laser array for dissipation of heat from said laser array.

24. Apparatus according to claim 19, wherein said means for activating said switch comprises an altimeter that issues an activation signal at a predetermined altitude.

25. Apparatus according to claim 19, wherein said means for activating the switch comprises a radio link between said tubular body and a person positioned adjacent to said area to be illuminated.

26. Apparatus according to claim 20, wherein said propulsion means comprises a rail gun that communicates an accelerating force to said tubular housing.

27. Apparatus according to claim 20, wherein said propulsion means comprises a compressed air gun that communicates an accelerating force to said tubular housing.

28. Apparatus according to claim 19 wherein laser radiation is directed from the forward portion of the body.

29. Apparatus according to claim 19 wherein laser radiation is directed from the rearward portion of the body.

30. A laser flare illumination system comprising, a semiconductor laser means for emitting laser radiation, including a radiation component of a wavelength $\lambda_1$, when the laser means is activated;

an energy source connected to the laser and having means for switching between a first state that delivers energy to and activates the laser and a second state that does not activate the laser;

a package that contains the laser and the energy source;

means for positioning the package at a height above an area to be illuminated; and night vision goggles to be worn by a person positioned adjacent to said area to be illuminated, where the night vision goggles are sensitive to radiation at said wavelength $\lambda_1$.

* * * * *